United States Patent [19]

Fushiya et al.

[11] Patent Number: 5,004,140

[45] Date of Patent: Apr. 2, 1991

[54] ELECTRICALLY-OPERATED TACKER

[75] Inventors: Fusao Fushiya; Yoshio Yokoyama, both of Nagoya; Akihito Hara, Aichi, all of Japan

[73] Assignee: Makita Electric Works, Ltd., Aichi, Japan

[21] Appl. No.: 513,572

[22] Filed: Apr. 23, 1990

[30] Foreign Application Priority Data

Apr. 24, 1989 [JP] Japan ..... 1-103638
Apr. 18, 1990 [JP] Japan ..... 2-102469

[51] Int. Cl.[5] ..... B25C 1/06

[52] U.S. Cl. ..... 227/8; 227/131; 227/146; 227/156

[58] Field of Search ..... 227/8, 131, 146, 156

[56] References Cited

U.S. PATENT DOCUMENTS

| | | | |
|---|---|---|---|
| 2,575,455 | 11/1951 | Lang | 227/146 X |
| 4,215,808 | 8/1980 | Sollberger et al. | 227/146 |
| 4,724,992 | 2/1988 | Ohmori | 227/146 |
| 4,807,793 | 2/1989 | Ghibely | 227/131 |
| 4,811,885 | 3/1989 | Lai | 227/131 |
| 4,834,278 | 5/1989 | Lin | 227/131 X |
| 4,953,774 | 9/1990 | Lai | 227/8 X |

FOREIGN PATENT DOCUMENTS 60-135182 6/1985 Japan .

*Primary Examiner*—Paul A. Bell
*Attorney, Agent, or Firm*—Lahive & Cockfield

[57] ABSTRACT

An elecrically-operated tacker includes means for driving a tack which is urged toward a muzzle section by a spring, an operating means for moving the driving means back to a starting position, a switch having a push button, a trigger means having a pair of first and second depressing elements, a control member for maintaining the first depressing element in an operative position, a safety means for normally maintaining the control member in a safety position, first and second engaging elements provided on the operating means, third, fourth and fifth engaging elements on the driving means, and a release means. Initially the driving means is located in a starting position immediately before a first extreme position. When the trigger is depressed, the push button is depressed by the first depressing element to move the driving means for a slight distance to the first extreme position so that the driving means springs to the second extreme position by the action of the spring to drive a tack. At substantially the same time that the driving means springs to the second extreme position, the first depressing element is forced out of the engagement with the push button. However, before the first depressing element is disengaged therefrom, the second depressing element is allowed to engage with the push button. When the driving means has reached the second extreme position, the second engaging element engages with the third engaging element to move the driving means to a substantially middle position and, then the first engaging element engages with the fourth engaging element to move the driving means to the starting position. At the same time that the driving means reaches the starting position, the release means disengages the second depressing element from the push button of the switch to switch the tacker off.

16 Claims, 9 Drawing Sheets

(c)

(d)

ELECTRICALLY-OPERATED TACKER

FIELD OF THE INVENTION

This invention relates to an electrically-operated tacker.

BACKGROUND OF THE INVENTION (1) One of the conventional electric tackers is disclosed in Japanese Patent Application No. 58-249626 (published under No. 60-135182). The electric tacker disclosed therein includes a primary switch for closing or opening the circuit connecting a battery and an electric motor and a secondary switch (cam switch) connected to the primary switch in series to ensure that the tacker discharges only one shot each time a trigger is depressed. A hammer for driving a tack is provided with a horizontal projection which is adapted to engage with a driving cam. The driving cam is operated by the motor. Initially the hammer is in a bottom dead center, and the driving cam is in such an orientation that the driving cam can engage with the horizontal projection of the hammer immediately after the driving cam is operated. When the trigger is depressed, the primary switch is actuated so that the driving cam starts to rotate and engages with the horizontal projection of the hammer to raise the hammer from the bottom dead center to a top dead center. When the hammer has reached the top dead center, the driving cam disengages from the hammer with the result that the hammer is pushed down to the bottom dead center by the action of a spring. The hammer thus drives a tack into an object to be tacked. When the hammer has returned to the bottom dead center, the secondary switch is activated to stop the motor. Then, the operator releases his hold on the trigger. Then, the motor starts again to reorientate the driving cam such that the driving cam can engage with the hammer instantly the operator depresses the trigger again. Then, the secondary switch is deactivated to stop the motor again.

This conventional tacker has the following drawbacks:

[I] Initially the hammer is in the bottom dead center, or in its lowest position. Therefore, the operation of depressing the trigger does not cause the hammer to drive a tack instantly. If the tacker is modified to start down from the top dead center to drive a tack on the bottom dead center and return to the top dead center, the operator can drive a tack instantly he triggers the tacker.

[II] Also, it appears that the hammer head initially is located out of the muzzle section since the hammer initially is in the bottom dead center. Thus, it is difficult to press the muzzle section properly against the required position on an object to be tacked. In addition, it is possible that, for the same reason, the hammer head may damage the object to be tacked when the muzzle section is pressed against the object.

[III] Moreover, since the hammer starts up, the hammer not only is unable to drive a tack, but also returns down to the bottom dead center if the battery happens to run down when the hammer is rising to the top dead center.

[IV] Furthermore, as described above, after the operator has released his hold on the trigger, the motor starts again to reorientate the driving cam. That is, making one shot involves applying an electric current to the motor twice. The electric current consumed to reorientate the driving cam is a waste of energy.

[V] The necessity to use the two switches, primary and secondary, makes the tacker a costly construction. It is possible to produce an electric tacker with only one switch.

[VI] Also, since the driving cam lifts up the hammer from the bottom dead center to the top dead center by making a substantially half rotation, a large torque is required. In addition, the necessity to provide a space in which the driving cam can make such a rotation makes it impossible to produce a compact tacker.

(2) Another conventional electric tacker is disclosed in Japanese Utility Model Application No. 60-172074 (published under No. 62-81581). This Japanese application has a corresponding U.S. Pat. No. 4,724,992. The electric tacker disclosed therein has a switch plate with a forward end which is initially in a recess in a hammer cam and a connector plate with an operating projection which is initially in an offset portion of the hammer cam. The connector plate also has a catch projection which is initially in engagement with a connector. The connector is also in engagement with the switch plate. A rearward end of the switch plate is in contact with a push button of a switch for an electric motor. Initially the hammer is in top dead center. When a trigger is depressed, the connector plate is moved rearward to move the switch plate rearward. Hence, the forward end of the switch plate disengages from the recess in the hammer cam, and the hammer is pushed down by the action of a spring. The hammer thus drives a tack into an object to be tack, on a bottom dead center. At the same time that the forward end of the switch plate disengages from the recess, the push button is depressed by the rearward end of the switch plate to start the motor. The motor operates a driving member. A worm wheel is in engagement with the driving member, and is provided with engaging projections. The worm wheel is rotated by the driving member. When the hammer is pushed down, the operating projection of the connector plate disengages from the offset portion of the hammer cam since the offset portion moves down. When the hammer has been pushed down, one of the engaging projections of the worm wheel comes into engagement with the bottom of the hammer and returns the hammer to the top dead center. Then, the forward end of the switch plate engages with the recess of the hammer again. At the same time, the push button is released. Then, the operator releases his hold on the trigger. Since the operating projection of the connector plate does not engage with the offset portion of the hammer cam again (and, hence, the operating projection of the connector plate does not engage with the connector again) unless the operator releases his hold on the trigger, there is no possibility that the operator may make two shots by depressing the trigger once.

Unlike the hammer of the first-mentioned tacker, the hammer of this conventional tacker starts from the top dead center drive a tack on the bottom dead center and returns to the top dead center. This conventional tacker has an advantage over the first-mentioned tacker in this respect.

However, this tacker has the following drawbacks:

[I] As understood from the foregoing description, the hammer of this tacker is not electrically pushed down. As described above, when the operator moves the switch plate reward through the connector plate by depressing the trigger. By so doing, the operator disengages the forward end of the switch plate from the hammer cam to push the hammer down. Hence, depressing the trigger does not start down the hammer lightly and quickly. The motor is not used to start the hammer, but used to raise the hammer from the bottom dead center.

[II] If the battery happens to run short of electricity when the hammer is being raised from the bottom dead center, the hammer stops, but does not return to the bottom dead center since the worm wheel is in engagement with the driving member. This tacker has an advantage over the first-mentioned tacker in this respect. However, in such an event, if the operator releases his hold on the trigger, the push button of the switch remains depressed by the rearward end of the switch plate. Hence, the cells of the battery and the motor make a closed circuit. Therefore, if the amounts of electricity that remains in the cells are different, the cell where the smallest amount of electricity remains discharges an excessive amount of electricity and electrolysis occurs in that cell. Thus, that cell is no longer capable of being used.

(3) A different electric tacker is disclosed in Japanese Patent Application No. 62-189984 (published under No. 63-174882). This application has a corresponding U.S. Pat. No. 4,807,793. The electric tacker disclosed therein includes a rod which is normally in alignment with, but is away from, a push button of a switch for an electric motor. The tacker also includes a gear with a toothed segment which can engage with a hammer. The gear is also provided with a release pin. Initially the hammer is in a bottom dead center. When a trigger is depressed, the rod depresses the push button, with its lower end, to rotate the gear. Thus, the toothed segment of the gear comes into engagement with the hammer to raise the hammer until the hammer reaches a top dead center. Then, the toothed segment disengages from the hammer and, hence, the hammer is pushed down from the top dead center by the action of a spring to drive a tack. At the same that the hammer reaches the top dead center, the release pin of the gear engages with a central portion of the rod to disengage the lower end of the rod from the push button. The push button is thus released to switch off the tacker. The hammer is in the bottom dead center. Then, the operator releases his hold on the trigger. The rod thus returns to the upper position, and is returned, by the action of a return spring, to the initial position where the rod is aligned with the push button of the switch again.

This conventional tacker has the following drawbacks:

[I] The tacker has the same disadvantage as the first-mentioned tacker, namely, the disadvantage that the hammer starts up from the bottom dead center to drive a tack.

[II] It is a superficial view that initially the toothed segment of the gear is shortly before its engagement with the hammer. It should be said that, only when the toothed segment is shortly before its engagement with the hammer, the toothed segment comes into engagement with the hammer instantly the trigger is depressed. That is, when the toothed segment has raised the hammer to the top dead center and has disengaged from the hammer, the push button is released to stop the gear. Hence, the toothed segment is stopped in a position far away from the initial position. Thus, when the trigger is depressed to make a next shot, the toothed segment does not engage quickly with the hammer. This disadvantage, coupled with the first-mentioned drawback, results in a very slow response.

[III] In addition, if the motor stops, whether by a shortage of the electricity in the battery or by an insufficient depression of the trigger, and the gear stops when the rod is between the release pin and the return spring, the rod does not return to the initial position if the operator releases his hold on the trigger and instead the rod is fixed in the position between the release pin and the return spring where the rod is out of alignment with the push button of the switch. Thus, the push button of the switch cannot be depressed if the trigger is depressed again. In such a case, it is necessary for the operator to rotate the gear manually to disengage the release pin of the gear from the rod so that he can operate the tacker again.

[IV] Moreover, the tacker has the same disadvantage as the first-mentioned tacker, namely, the disadvantage that a large torque is required since the gear lifts up the hammer from the bottom dead center to the top dead center by making a substantially half rotation. Also, as with the first-mentioned tacker, the necessity to provide a space in which the gear can make such a rotation makes it impossible to produce a compact tacker.

SUMMARY OF THE INVENTION

Accordingly, it is the object of the invention to provide an electrically-operated tacker which is free from the foregoing drawbacks of the above-mentioned conventional tackers.

BRIEF DESCRIPTION OF THE DRAWING

FIG. 4 also depicts the control member;

DETAILED DESCRIPTION OF A PREFERRED EMBODIMENT

Figure 1:
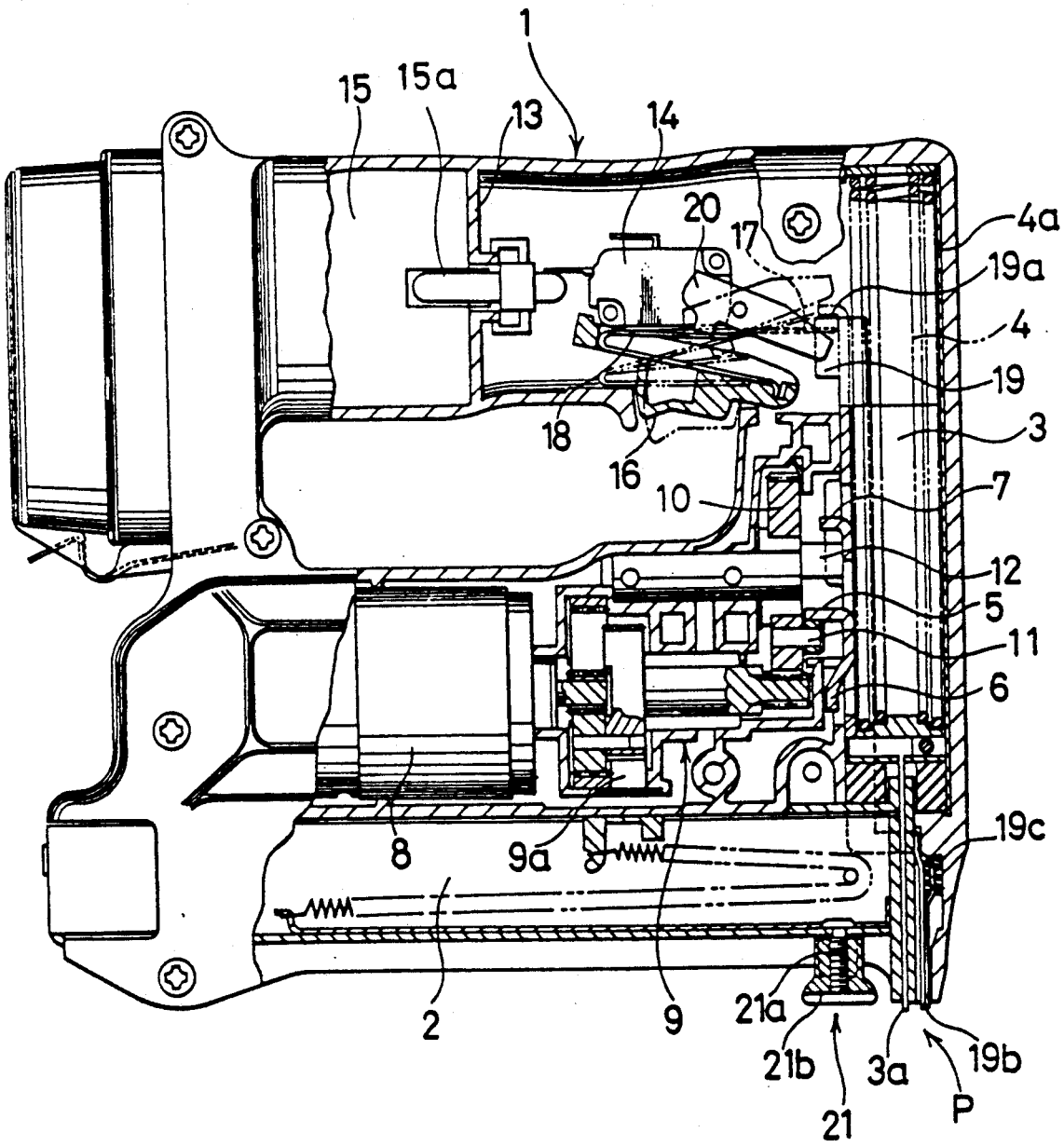
FIG. 1 shows an electrically-operated tacker of the invention.

An electrically-operated tacker which embodies the invention in a preferred form will now be described with reference to the drawing.

Figure 4:
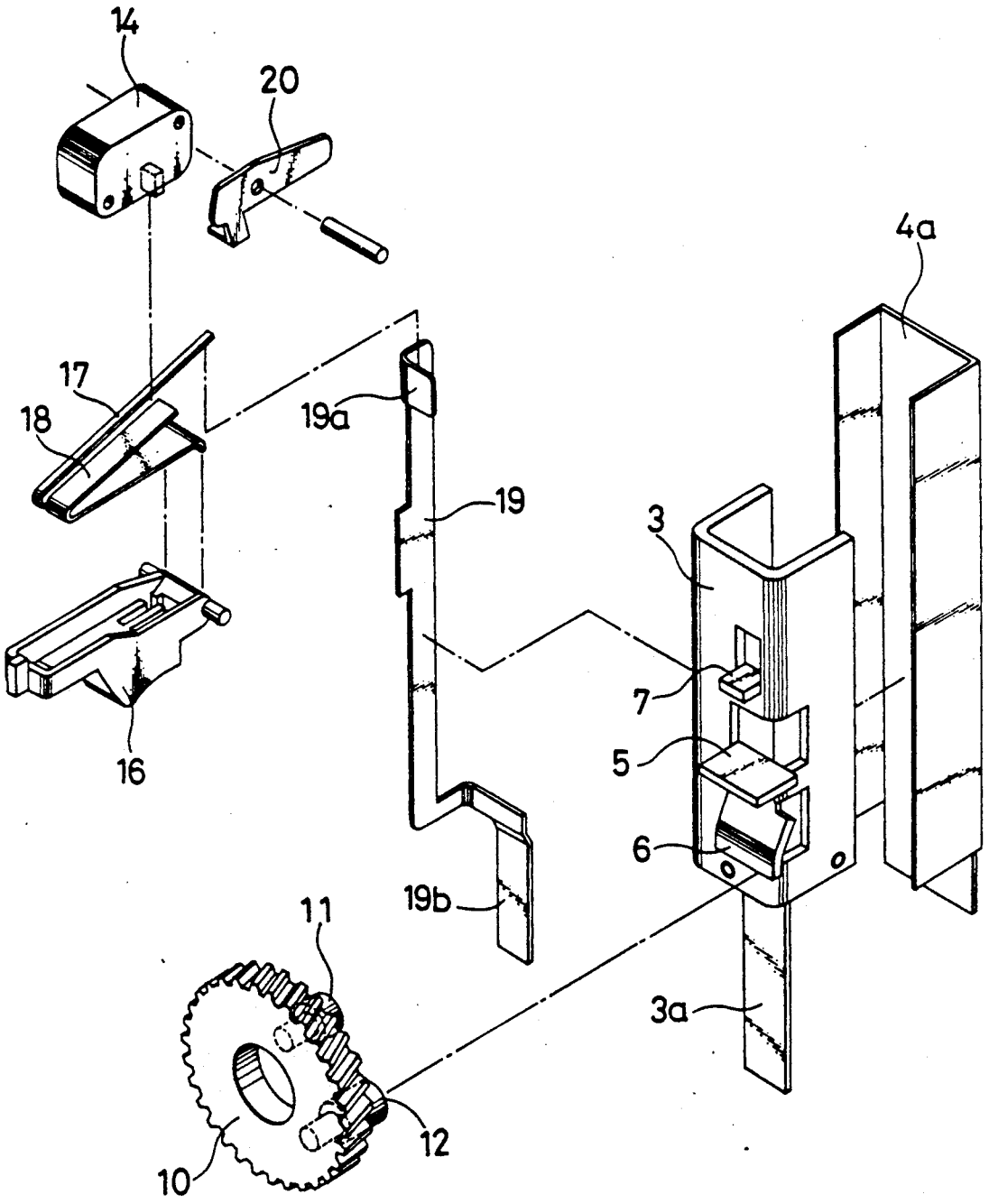
FIG. 4 is an exploded view of the hammer and a switch mechanism.
Figure 5:
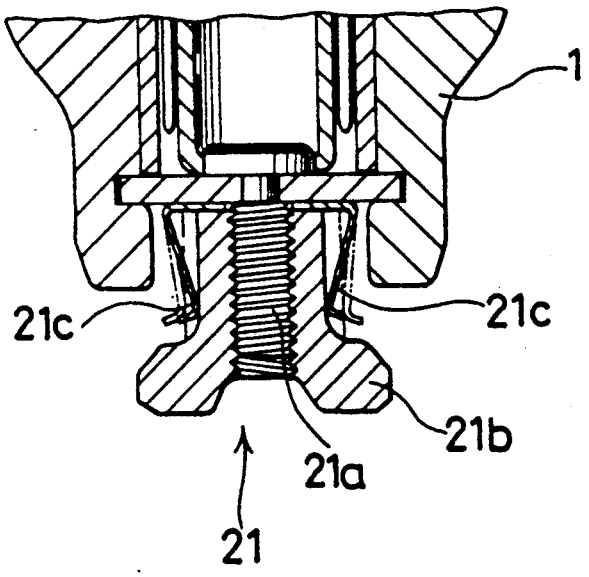
FIG. 5 shows a mechanism for adjusting the depth to which a tacker is driven.

Referring to FIG. 1, an electrically-operated tacker of the invention includes a housing 1 of synthetic resin. In the housing 1 a "muzzle" section P is located on the lower right. A magazine 2 charged with tacks N is located along the bottom of the housing 1 such that each tack N is driven from the muzzle section P by a pusher 3*a* of a hammer 3. The hammer 3 is located at a right angle to the magazine 2. Also, the hammer 3 is located in a guide member 4*a*. The guide member 4*a* is open in its left-hand side (in FIG. 1), and generally has the shape of the letter "U" in its horizontal cross section. Also, the hammer 3 generally has the shape of the letter "U" in its horizontal cross section. The hammer 3 is open in its right-hand side. The hammer 3 is urged toward the muzzle section P by a coil spring 4, and is slidable along the guide member 4a on the inner surface thereof. That is, the hammer 3 is slidable toward or away from the muzzle section P. The hammer 3 has a pusher 3a with which to drive a tack N. The pusher 3a is a portion of the hammer 3 projecting downward from a hammer body (FIG. 4). The hammer body has an upper projection 7, a middle projection 5 and a lower projection 6. The upper and middle projections 7 and 5 may be so formed as to run parallel to each other, as shown in FIG. 4. Also, the lower projection 6 may be so formed as to form a right angle with the upper and middle projections 7 and 5, as shown in FIG. 5. An electric motor 8 and a speed reducing mechanism 9 are located above the magazine 2. The speed reducing mechanism 9 is operatively connected to the electric motor 8. A disc 10 is located by the side of the hammer 3. The disc 10 is provided with teeth. The disc 10 is operatively connected to the speed reducing mechanism 9 at its teeth. Thus, when the motor 8 is operated, the disc 10 is rotated through the speed reducing mechanism 9. A pawl 9a is in engagement with the speed reducing mechanism 9, and allows the latter 9 to rotate in one direction only. Therefore, the disc 10 is rotated in one direction only. To be more exact, the disc 10 is rotated only in a counterclockwise direction when viewed from the side of the motor 8.

The disc 10 is provided with a pair of pins 11 and 12 projecting therefrom toward the hammer 3. The pin 12 is longer than the pin 11. The pins 11 and 12 are spaced apart from each other for less than 180 degrees along the circumference of the disc 10. When the disc 10 is rotated, the pins 11 and 12 make circular motions.

The tacker has a substantially central opening. A portion of the tacker located above the central opening provides a grip 13 by which the tacker is grasped. A battery 15 is located within the grip 13, and is held by leaf springs 15a. The battery 15 is a secondary battery. Also, a switch 14 is located within the grip 13. The switch 14 is electrically connected to the battery 15. Also, the motor 8 is electrically connected to the switch 14. Thus, when the switch 14 is closed, the motor 8 is energized to rotate the disc 10. When the disc 10 is rotated, the hammer 3 is urged downward from its uppermost position by the action of the coil spring 4 and, hence, the pusher 3a thereof drives a tack N from the muzzle section P. After the hammer 3 has reached its lowest position, the short pin 11 engages with the middle projection 5 of the hammer 3 as the disc 10 rotates, thereby moving the hammer 3 upward to a substantially middle position. In other words, after the hammer 3 has reached its lowest position, the short pin 11 engages with the middle projection 5 only for such a duration of time that the hammer 3 moves from its lowest position to its middle position. And at substantially the same time that the short pin 11 disengages from the middle projection 5, the long pin 12 of the disc 10 engages with the lower projection 6 of the hammer 3 to move the hammer 3 to a position slightly lower than the uppermost position thereof.

Thus, the short pin 11 has an operational relation with the middle projection 5, while the long pin 12 has an operational relation with the lower projection 6.

Figure 2:
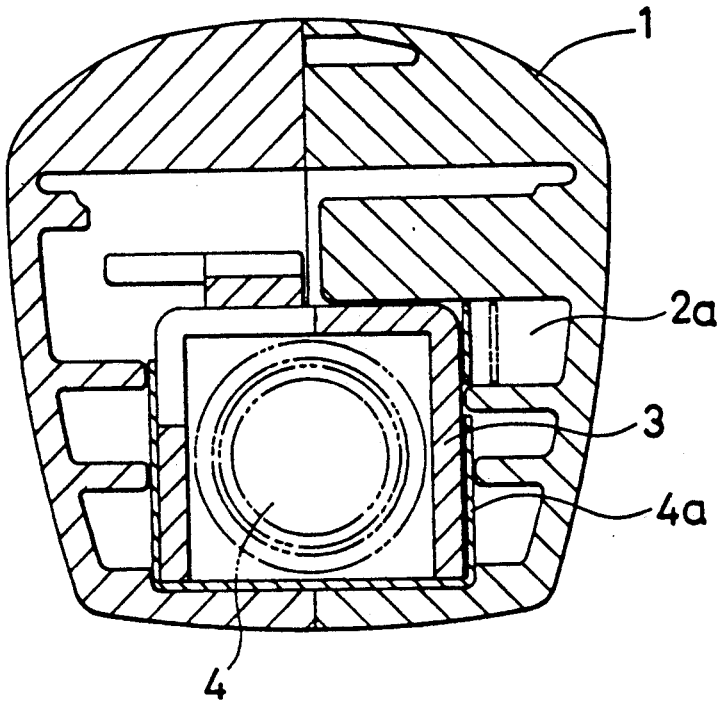
FIG. 2 is a horizontal cross section of part of the tacker of FIG. 1 in which a housing, a hammer and a control member are illustrated.
Figure 3:
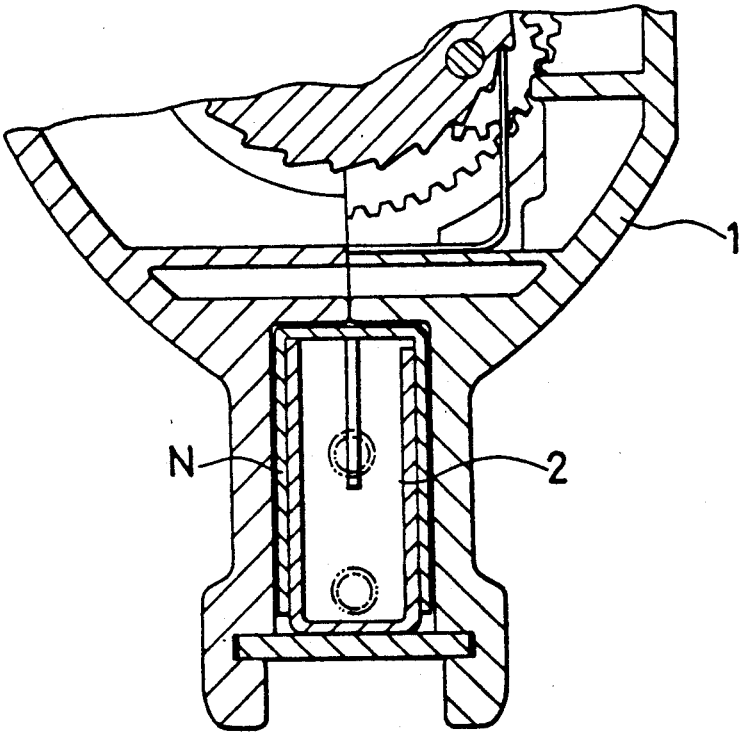
FIG. 3 shows a preventing means which allows a disc to be rotated in only one direction.

A trigger 16 is located below the switch 14. A lower portion of the trigger 16 is exposed to the central opening. When the trigger 16 is depressed (from below), the trigger 16 is turned about its right-hand end. A generally V-shaped leaf spring is connected to the trigger 16 (FIG. 4). The upper portion of this leaf spring is separated into two to provide a pair of depressing elements 17 and 18. The depressing element 17 is longer and narrower than the depressing element 18. The switch 14 is provided with a push button 14a. The long depressing element 17 is in contact with a left-hand portion (as viewed from the side of the battery 15) of the lower surface of the push button 14a at a middle portion thereof at all times. A springy control member 19 is located in a groove 1a (FIG. 2). The control member 19 is vertically slidable between an upper position and a lower position. A lower portion 19b of the control member 19 serves as a safety plate, as described in detail later. The safety plate 19b is located in the muzzle section P. The safety plate 19b is normally urged downward out of the housing 1 by a spring 19c. Therefore, the control member 19 is normally in its lower position. The control member 19 is moved (slided) to its upper position only when the safety plate 19b is pressed against an object to be tacked, against the action of the spring 19c. The safety plate 19b is located below the hammer body, while the greater part thereof is located on the left-hand side of the hammer body as viewed from the side of the motor 8. Reference numeral 19a designates a portion of the control member 19 projecting from the left side to the right side as viewed from the side of the switch 14. This projecting portion 19a serves as a stopper. That is, when the safety plate 19b has been pressed against an object to be tacked and, hence, the control member 19 is in its upper position, the lower surface of the distal end portion of the long depressing element 17 is in contact with, or is supported by, the top of the projecting portion 19a.

The short depressing element 18 comes into engagement with the push button 14a and keeps the latter in the state of being depressed, at a left-hand portion thereof (as viewed from the side of the battery 15).

A pin 23 is located in close proximity to a corner of the switch 14 (FIGS. 1 and 4). A lever 20 is supported on the pin 23. The lever 20 can be turned about the pin 23. The lever 20 has a portion 24 projecting from the right side of the left side as viewed from the side of the battery 15. This projecting portion 24 is in contact with a right-hand portion of the upper surface of the short depressing element 18 (as viewed from the side of the battery 15) at all times. The short depressing element 18 can be engaged with the push button 14a at a left-hand portion of the upper surface thereof (as viewed from the side of the battery 15).

When the tacker is not in operation, the right-hand end of the lever 20 (in FIG. 1) is lifted up by the upper projection 7 of the hammer 3, and the short depressing element 18 is forced away from the push button 14a by the projecting portion 24 of the lever 20. Thus, in this condition the push button 14a cannot be depressed by the short depressing element 18 if the trigger 16 is depressed. The tacker is in this condition when the control element 19 is in its lower position. In addition, when the control element 19 is in its lower position, the push button 14a also cannot be depressed by the long depressing element 17 if the trigger 16 is depressed. The long depressing element 17 cannot depress the push button 14a unless the long depressing element 17 is supported by the stopper 19*a*. In other words, the long depressing element 17 cannot depress the push button 14*a* unless the control member 19 is in its upper position. Thus, the push button 14*a* cannot be depressed when the safety plate 19*b* is urged out of the housing 1.

In operation, the safety plate 19*b* is pressed against an object to be tacked and, hence, the distal end portion of the long depressing element 17 becomes supported by the stopper 19*a*. The short depressing element 18 is in the state of being forced away from the push button 14*a* by the projecting portion 24 of the lever 20. Then, the trigger 16 is depressed. It causes the long depressing element 17 to depress the push button 14*a* to start the tacker. The short depressing element 18 now cannot depress the push button 14*a* since the short depressing element 18 is now away from the push button 14*a*. However, as soon as the tacker has been started, the long pin 12 of the disc 10 pushes a portion 19*d* of the control member 19 projecting from the right side to the left side (as viewed from the side of the motor 8). Thus, the stopper 19*a* moves to the left (as viewed from the side of the trigger 16) away from the long depressing element 17. The distal end portion of the long depressing element 17 thus disengages from the stopper 19*a* and lowers, so that the long depressing element 17 no longer depresses the push button 14*a*. However, when the long depressing element 17 no longer depresses the push button 14*a*, the short depressing element 18 is already depressing the push button 14*a*, as understood later. Thus, the energization of the motor 8 is not interrupted.

The magazine 2 is provided, at its bottom, with a mechanism 21 for adjusting the depth to which tacks N are to be driven (FIGS. 1 and 5). This adjusting mechanism 21 is located in close proximity to the muzzle section P, and includes a stud bolt 21*a* and a thumb nut 21*b* engaging with the stud bolt 21*a*. The thumb nut 21*b* can be rotated to move it along the axis of the stud bolt 21*a*. Two opposed outer surfaces of the thumb nut 21*b* are flat. The thumb nut 21*b* is held by a pair of leaf springs 21*c* at the respective flat surfaces thereof such that the thumb nut 21*b* cannot be rotated unless a large force is used to rotate it. Thus, when the tacker is in operation, the thumb nut 21*b* is virtually prevented from accidentally rotating and, hence, there is virtually no possibility that the depth to which tacks N are to be driven accidentally may vary.

Figure 6:
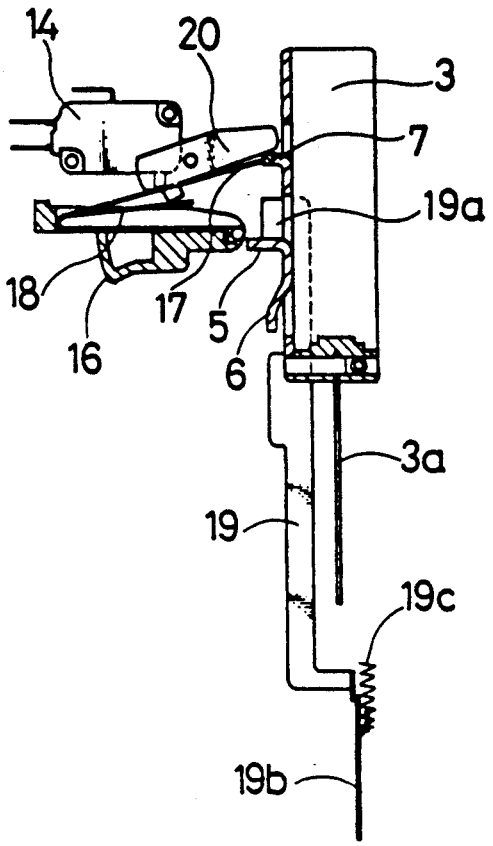
FIGS. 6(*a*)–6(*h*) and 7(*a*)–7(*d*) illustrate operational relations between operating pins and the hammer.
Figure 6:
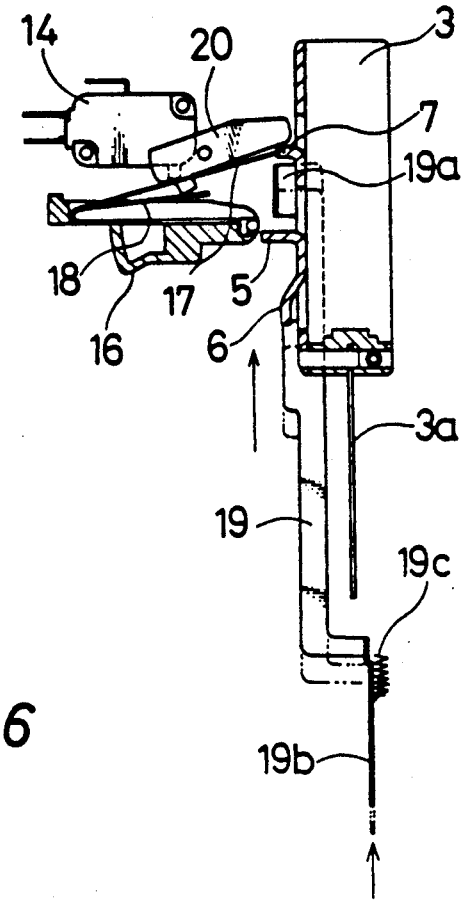
Figure 6:
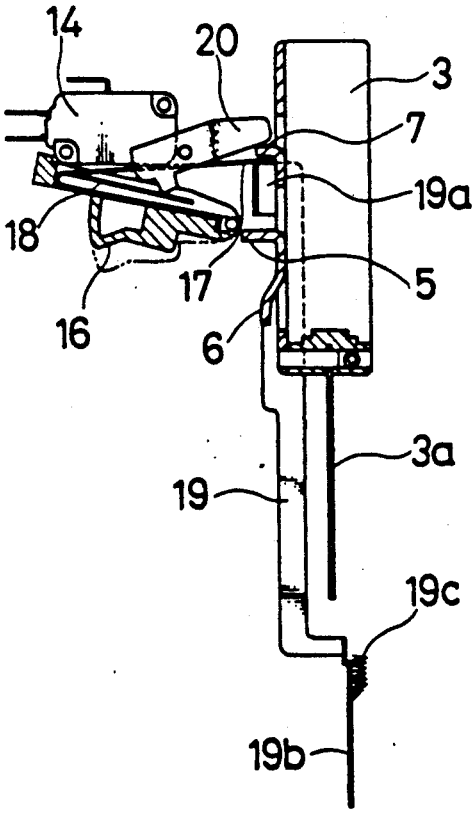
Figure 6:
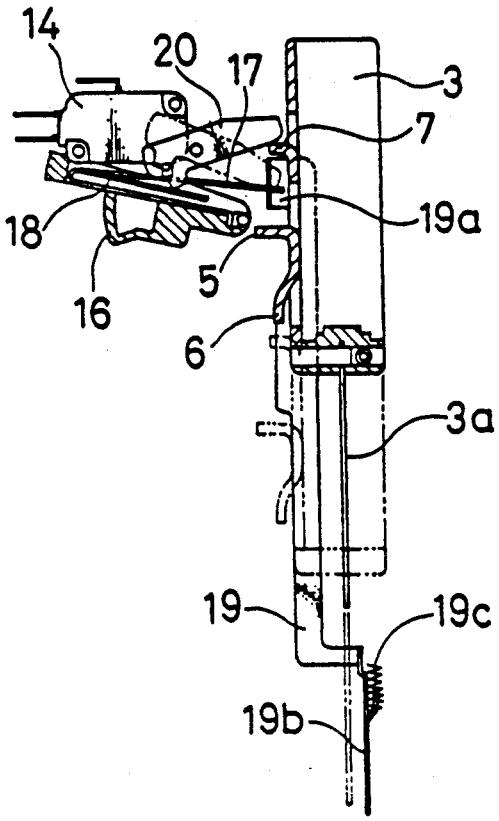
Figure 6:
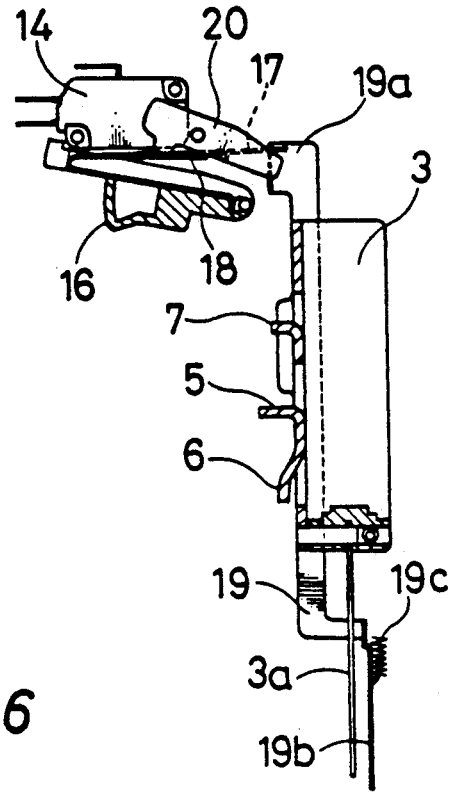
Figure 6:
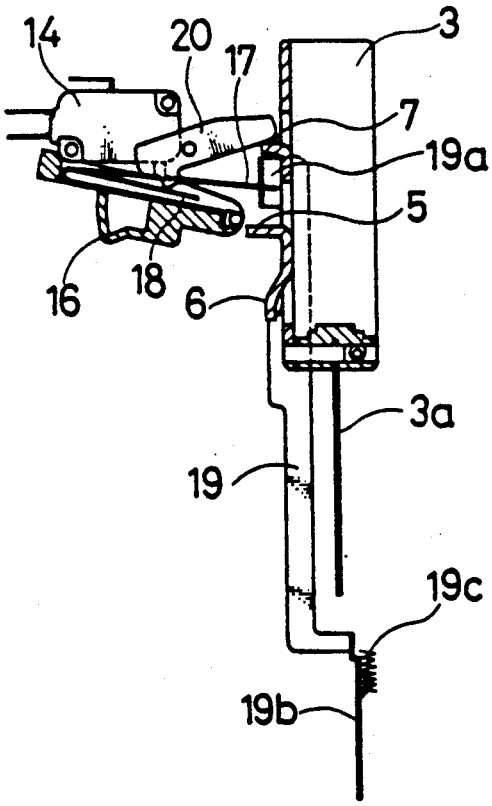
Figure 6:
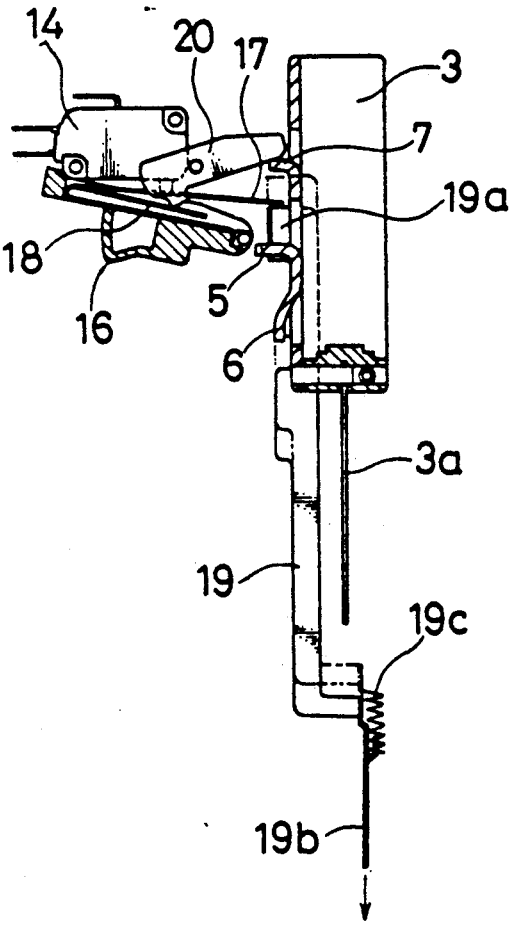
Figure 6:
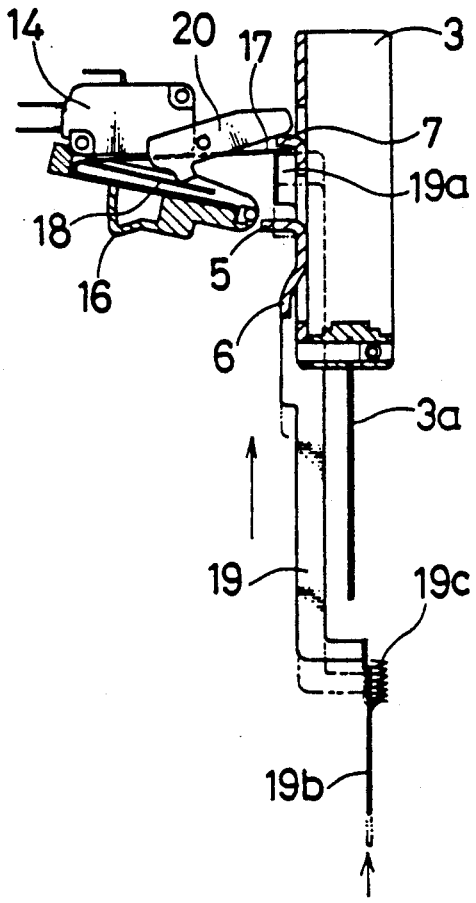

Initially the hammer 3 is in a position slightly lower than its uppermost position (FIGS. 6(*a*) and 7(*a*)), and the long pin 12 of the disc 10 is in engagement with the bottom of the lower projection 6 of the hammer 3. Also, initially the upper projection 7 of the hammer 3 is in engagement with the right-hand end (in FIG. 1) of the lever 20 and, hence, the lever 20 is in the state of being turned by the upper projection 7 in a counterclockwise direction (in FIG. 1). The short depressing element 18 of the trigger 16 is not in engagement with the push button 14*a* of the switch 14, but is spaced apart from the push button 14*a* by the projecting portion 24 of the lever 20 (FIG. 6(*a*)). The long depressing element 17 is in engagement with the push button 14*a*, but is not in engagement with the stopper 19*a* of the control member 19. As described before, the long depressing element 17 is in engagement with the push button 14*a* at all times.

When the tacker is to be operated, the operator presses the muzzle section P against an object to be tacked, thereby pressing the safety plate 19*b* against the object against the action of the spring 19*c* (FIG. 6(*b*)). Thus, the control member 19 is moved to its upper position and, hence, the stopper 19*a* thereof comes into engagement with the lower surface of the distal end portion of the long depressing element 17. Then, the operator depresses the trigger 16 with a finger (FIG. 6(*c*)). Now the push button 14*a* of the switch 14 has been depressed by the long depressing element 17 of the trigger 16 and, hence, the switch 14 has been closed. Thus, the motor 8 is energized to rotate the disc 10 (in a clockwise direction as viewed from the side of the hammer 3). Thus, the long pin 12 of the disc 10, which is now in engagement with the lower projection 6 of the hammer 3, moves clockwise (as viewed from the side of the hammer 3) to raise the hammer 3 slightly. The hammer 3 thus reaches its uppermost position. At the same time that the hammer 3 is thus moved to its uppermost position, the upper projection 7 of the hammer 3, which is now in engagement with the right-hand end (in FIG. 1) of the lever 20, slightly moves the lever 20 clockwise (FIG. 6(*d*)) and, hence, the short pin 11 of the trigger 16 is forced down further away from the push button 14*a* by the projecting portion 24 of the lever 20. Then, the long pin 12 of the disc 10 disengages from the lower projection 6 of the hammer 3. Now that the hammer 3 is no longer supported from below, the hammer 3 is pushed down by the action of the coil spring 4 (FIGS. 6(*e*) and 7(*b*)). Thus, the upper projection 7 of the hammer 3 disengages from the lever 20 (FIG. 6(*d*)) and, hence, the distal end portion of the short depressing element 18 of the trigger 16 springs back, or upward, and comes into engagement with the push button 14*a* which is being depressed by the long depressing element 17 (FIG. 6(*d*)). The short depressing element 18 turns the lever 20 clockwise by springing back.

The hammer 3 is pushed down as described above. The hammer 3 thus drives a tack N loaded in the magazine 2, into an object to be tacked. To be more exact, the hammer 3 drives a tack N with its pusher 3*a*. At substantially the same time that the hammer 3 is pushed down, but at a slightly later point of time than the short depressing element 18 has come into engagement with the push button 14*a*, the long pin 12 of the disc 10 engages with the projection 19*d* of the control member 19. The upper portion of the control member 19 is thus inclined to the left (as viewed from the side of the trigger 16) (FIG. 7(*c*)) and, hence, the stopper 19*a* of the control member 19 disengages from the distal end portion of the long depressing element 17 with the result that the distal end portion thereof moves to a position slightly lower than the position in which the distal end portion thereof was in engagement with the stopper 19*a*. The long depressing element 17 thus loses the force of depressing the push button 14*a*. Since the disc 10 is moving clockwise (as viewed from the side of the hammer 3), the long pin 12 thereof engages with the projecting portion 19*d* of the control member 19 only for a very short period of time. Thus, since the control member 19 is formed of springy material, the upper portion of the control member 19 starts to spring back from the inclined position to the initial position when the long pin 12 has disengaged from the projecting portion 19*d* of the control member 19. However, the distal end portion of the long depressing element 17, which is now in the foregoing slightly lower position, prevents the upper portion of the control member 19 from completely returning to its initial position. That is, immediately after the upper portion of the control member 19 has started to spring back to the initial position, the stopper 19*a* engages not with the lower surface of the distal end portion of the long depressing member 17, but with one side of the distal end portion thereof (i.e., the left side thereof as viewed from the side of the switch 14). From a different point of view, once the distal end portion of the long depressing element 17 has moved to the foregoing slightly lower position, the distal end portion thereof does not return to the upper position where the lower surface of the distal end portion thereof can be supported by the stopper 19*a* until the operator has released his hold on the trigger 16 (, as will be understood later).

Immediately before the long pin 12 disengages from the projecting portion 19*d* of the control member 19, the short pin 11 engages with the lower surface of the middle projection 5 of the hammer 3.

As described above, the long depressing element 17 has lost the force of depressing the push button 14*a*. However, at this point of time the short depressing element 18 is already in engagement with the push button 14*a* and, hence, the short depressing element 18 instead of the long depressing element 17 now keeps the push button 14*a* in the state of being depressed.

It will be appreciated that though only for a very, very short period of time, the depressing elements 17 and 18 keep depressing the push button 14*a* together. That is, the depressing elements 17 and 18 keep depressing the push button 14*a* together for the very short interval from the point of time when the upper projection 7 has disengaged from the lever 20 up to the point of time when the long pin 12 has engaged with the projection 19*d* of the control member 19.

The hammer 3 has already driven the tack N into the object to be tacked. The hammer 3 is thus now in its lowest position. The short depressing element 17 along is depressing the push button 14*a*. It will be appreciated that the switch 14 has never been opened since the operator depressed the trigger 16. Hence the disc 10 is continuously moving clockwise (as viewed from the side of the hammer 3). Needless to say, the operator is still depressing the trigger 16.

As described above, the short pin 11 engaged with the lower surface of the middle projection 5 of the hammer 3 immediately before the long pin 12 disengaged from the projecting portion 19*d* of the control member 19. Thus, the short pin 11 has already started to raise the hammer 3 from its lowest position against the action of the coil spring 4. The short pin 11 raises the hammer 3 to a substantially middle position (FIG. 7(*d*)). Then, the short pin 11 disengages from the middle projection 5. At substantially the same time that the short pin 11 disengages from the middle projection 5, the long pin 12 engages with the bottom of the lower projection 6 again. Thus, the long pin 12 instead of the short pin 11 further raises the hammer 3. The hammer 3 is thus continuously returned from the lowest position to the initial position.

Soon after passing the middle position, but before reaching the initial position, the upper projection 7 of the hammer 3 engages with the right-hand end of the lever 20. The upper projection 7 thus turns the lever 20 counterclockwise and, hence, the short depressing element 18 of the trigger 16 is disengaged from the push button 14*a* by the projecting portion 24 of the lever 20 (FIG. 6(*e*)). Therefore, the push button 14*a* is released to open the switch 14.

At substantially the same time that the hammer 3 reaches the initial position, the push button 14*a* is completely released. Then, the operator releases his hold on the trigger 16. Thus, the distal end portion of the long depressing element 17 slides upward on the left side of the stopper 19*a* of the control member 19 and rests on the top of the stopper 19*a*. At the same time that the above-mentioned distal end portion rests on the top of the stopper 19*a*, the stopper 19*a* returns to the initial position since the long depressing element 17 no longer prevents the upper portion of the control member 19 from springing back to its initial position.

Thus, when the operator has released his hold on the trigger 16, all the movable and rotatable elements return to their initial positions. Then, the operator moves the tacker away from the object which has been tacked by the foregoing operation. Thus, the safety plate 19*b* is urged out of the housing 1 by the action of the spring 19*c* and, hence, the stopper 19*a* disengages from the long depressing element 18. Now, therefore, the operator cannot operate the tacker if he depresses the trigger 16. Therefore, if the operator accidentally depresses the trigger 16 after moving the tacker away from the object, the tacker does not operate.

However, the operator can have another shot at a different position only by positioning the tacker against the different position and depressing the trigger 16 again.

It will be appreciated from the foregoing description that, each time the trigger 16 is depressed, the disc 10 makes one rotation. While the disc 10 makes one rotation, the hammer 3 discharges one shot.

It will also be appreciated from the foregoing description that the switch button 14*a* is released immediately before the operator releases his hold on the trigger 16. It means that the tacker is automatically switched off. Thus, the operator is prevented from making an unintentional shot since there is no possibility that the operator may make successive shots by depressing the trigger 16 once.

The pusher 3*a* of the hammer does not project from the housing 1 when it drives a tack.

As described before, if the trigger 16 is depressed, the tacker cannot be started unless the safety plate 19*b* is retracted. Usually the operator first presses the safety plate 19*b* against an object to be tacked (in order to retract the safety plate 19*b*) and then depresses the trigger 16. If the operator desires to do it, however, he may first depress the trigger 16 (FIG. 6(*g*)) and then press the safety plate 19*b* against the object (FIG. 6(*h*)). The operator can start the tacker in either way.

The hammer 3 is raised to its uppermost position by the long pin 12 of the disc 10, and when the long pin 12 has disengaged from the lower projection 6 of the hammer 3, the hammer is pushed down to drive a tack N. While the hammer 3 thus moves from its uppermost position to its lowest position, the two pins 12 and 11 of the disc are moving on the left side of the hammer (as viewed from the side of the disc 10) without engaging the pins 12 and 11 and, hence, do not hinder the straight movement of the hammer 3 from its uppermost to its lowest position.

Figure 7:
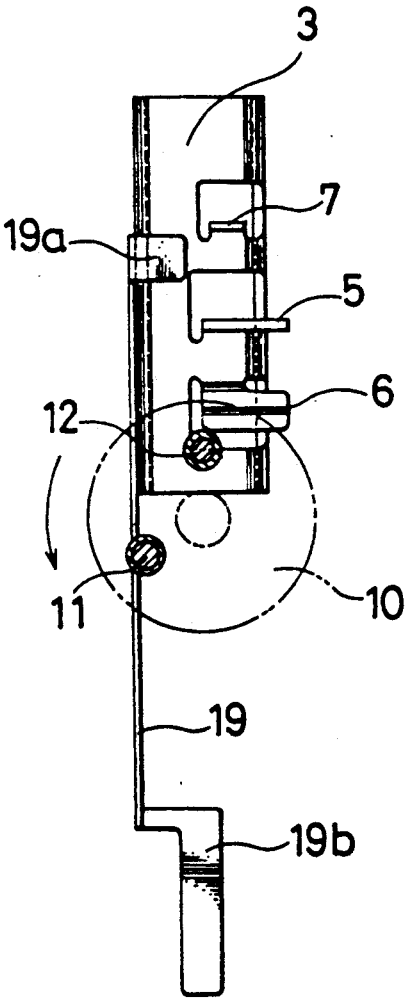
Figure 7:
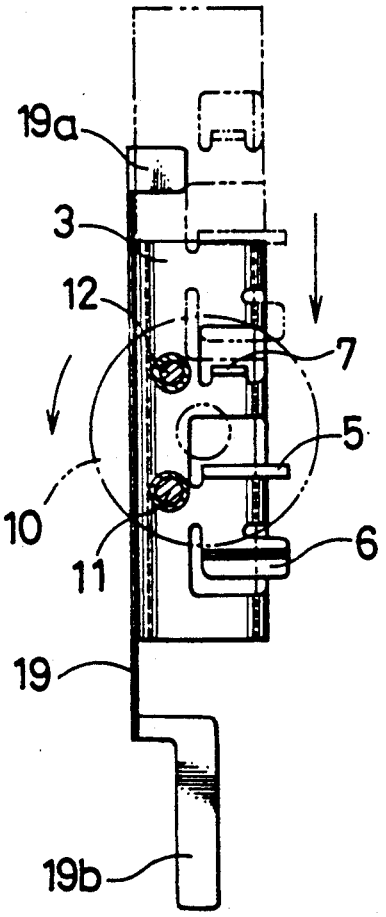
Figure 7:
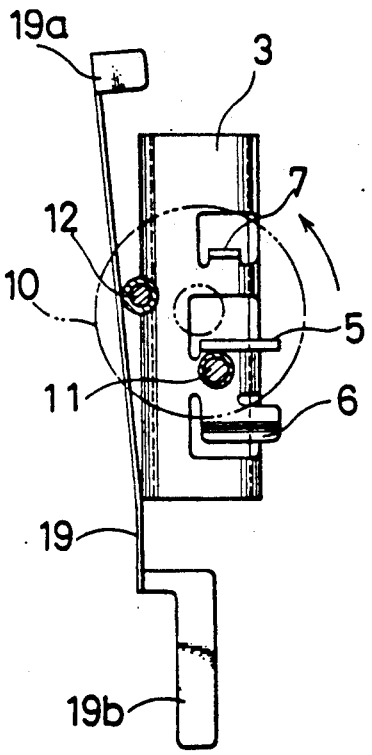
Figure 7:
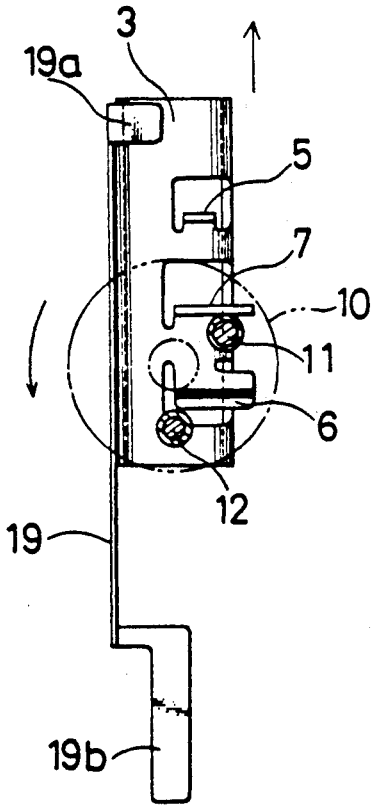

If the operator does not depress the trigger 16 sufficiently, it is possible that, after driving a tack N, the hammer 3 may stop on the way from its lowest position to its initial position (e.g., on the position of FIG. 7(*d*)). If it has happened, the hammer 3 is pushed down by the spring 4 if the disc 10 is rotated in a counterclockwise direction (as viewed from the side of the hammer 3). However, since the pawl 9*a* which is in engagement with the speed reducing mechanism 9 allows the disc 10 to rotate only in only a clockwise direction (as viewed from the side of the hammer 3), the hammer 3 is not pushed down, but the pin 11 or 12 of the disc is in engagement with the projection 5 or 6 of the hammer 3 associated therewith without moving and thus prevents the hammer from being pushed down. Also, in such a case the distal end portion of the long depressing element 17 and the stopper 19*a* are in their initial positions, so that the distal end portion thereof is in engagement with the top of the stopper 19*a*. Therefore, if the trigger 16 is depressed again, the tacker is switched on again. The hammer 3 thus starts up from the position where the hammer 3 has stopped, to make a next shot. That is, in such a case the position where the hammer 3 has accidentally stopped is the starting position for the next shot.

Also, if the operator has depressed the trigger 16 sufficiently, the hammer 3 may happen to stop on the way from its lowest position to its initial position if the battery 15 has run short of electricity. If it has happened, the hammer 3 is not pushed down for the above-mentioned reason. If it has happened, the operator releases his hold on the trigger 16 to release the push button 14*a* of the switch 14. The operator thus can prevent the battery 15 from discharging an excessive amount of electricity. Now, as in the preceding case, the distal end portion of the long depressing element 17 is in engagement with the top of the stopper 19*a*. Then, the operator replaces the battery 15 with a new one and depresses the trigger 16 again. Thus, as in the preceding case, the hammer 3 starts up from the position where the hammer 3 has accidentally stopped, to make a next shot.

As described before, when the hammer 3 has driven a tack N, the short pin 11 of the disc 10 engages with the middle projection 5 of the hammer 3 as the disc 10 rotates, and moves the hammer 3 upward from its lowest position to a substantially middle position. When the short pin 11 has moved the hammer 3 to that position, the short pin 11 disengages from the middle projection 5. And at substantially the same time that the short pin 11 disengages from the middle projection 5, the long pin 12 of the disc 10 engages with the lower projection 6 of the hammer 3 to move the hammer 3 to the initial position slightly lower than the uppermost position thereof. Then, if only one pin is provided in conjunction with one projection to coact with that pin, the disc 10 must have substantially twice the illustrated radius to return the hammer 3 from its lowest position to its initial position. From this point of view, it may be safely said that, though small, the disc 10 is capable of moving the hammer 3 for its stroke. Thus, according to the invention, a gear with a small speed reduction ratio may be used. Also, the gear need not be large in size and, hence, a compact tacker may be produced.

As described above, the short pin 11 coacts with the middle projection, and the long pin 12 coacts with the lower projection 6. In addition, as described before, the long pin 12 also coacts (, or engages) with the projecting portion 19*d* of the control member 19 to disengage the stopper 19*a* of the control member 19 from the long depressing element 17.

The upper projection 7 of the hammer 3 coacts with the right-hand end of the lever 20 to switch off the tacker.

As described before, the safety plate 19*b* is normally urged out of the housing 1. The tacker cannot be operated unless the safety plate 19*b* is retracted. The safety plate 19*b* thus prevents the operator from unintentionally operating the tacker. In addition, although not shown, a safety element which does not allow the trigger to be depressed unless the safety element is disabled may be provided for a greater safety.

The tacks which can be driven by the tacker of the invention include, but are not limited to, inverted U-shaped tacks, T-shaped tacks and inverted L-shaped tacks.

As far as the terms such as "upper", "lower", "uppermost" and "lowest" are concerned, the foregoing description of the tacker applies only to the case where the tacker is used with its muzzle section P directed in a downward direction. Thus, for example, if the tacker is used with its muzzle section P directed to a vertical wall, such terms should be replaced with other proper terms.

What is claimed is:

1. An electrically-operated tacker comprising (a) a driving means initially located in a starting position immediately before a first extreme position for driving a tack into an object to be tacked, (b) means for urging the driving means toward a second extreme position opposite to the first extreme position such that the driving means can spring from the first extreme position to the second extreme position to drive the tack, (c) an operating means for moving the driving means from the second extreme position to the starting position against an action of the urging means, (d) an electric motor for operating the operating means, (e) a power source for supplying an electric current to the motor, (f) a switch for making or breaking an electrical connection between the power source and the motor, the switch having a push button, (g) a trigger means which can be directly depressed by an operator, (h) a first depressing element connected to the trigger means for depressing the push button of the switch to start the tacker when the trigger means is depressed by the operator, (i) a control member of a resilient material for maintaining the first depressing element in an operative position where the first depressing element can depress the push button, the control member being movable between a safety position where a first end of the control member is out of engagement with the first depressing element and a second, opposed end of the control member is out of a housing and an operating position where the first end of the control member is in engagement with the first depressing element and the second end of the control member is in the housing, (j) a safety means for normally maintaining the control member in the safety position where the control member does not allow the push button of the switch to be depressed if the trigger means is depressed, the first end of the control member locating the first depressing element to the operative position when the first end thereof comes into engagement with the first depressing element, (k) a first cooperative element which is moved as the operating means moves and is located to engage with the control member, at substantially the same time that the driving means springs from the first extreme position to the second extreme position, such that the first end of the control member is forced out of the engagement with the first depressing element to displace the first depressing element from the operative position to an inoperative position where the first depressing element no longer depresses the push button, (l) a second depressing element connected to the trigger means, the second depressing element coming into engagement with the push button which has already been depressed by the first depressing element, at the same time that the driving means moves away from the first extreme position, and holding the push button depressed after the first depressing element has been displaced to the inoperative position, (m) a second cooperative element which is moved as the operating means move, (n) a third cooperative element which is moved as the driving means moves and is operatively associated with the second cooperative element, the second cooperative element coming into engagement with the third cooperative element, after the driving means has reached the second extreme position, and remaining in the engagement with the third cooperative element until the driving means comes to a substantially middle position, (o) a fourth cooperative element which is moved as the driving means moves and is operatively associated with the first cooperative element, the first cooperative element coming into engagement with the fourth cooperative element, at substantially the same time that the second cooperative element disengages from the third cooperative element, and moving the fourth cooperative element to return the driving means to the starting position where the fourth cooperative element is still engaged by the first cooperative element to hold the driving means in the starting position, (p) a release means provided in conjunction with the second depressing element, and (q) a fifth cooperative element which is moved as the driving means moves and is operatively associated with the release means, the fifth cooperative element coming into engagement with the release means, at substantially the same time that the driving means reaches the starting position, to operate the release means to disengage the second depressing element from the push button, thereby switching the tacker off, and the first cooperative element moving the driving means for a slight distance to the first extreme position, when the trigger is depressed, and then disengaging from the fourth cooperative element to allow the driving means to spring to the second extreme position by the action of the urging means.

2. An electrically-operated tacker in accordance with claim 1 wherein the release means comprises a lever.

3. An electrically-operated tacker in accordance with claim 2 wherein the operating means comprises a gear wheel.

4. An electrically-operated tacker in accordance with claim 1 wherein at least one of the first and second depressing elements comprises a substantially V-shaped leaf spring located between the trigger means and the switch.

5. An electrically-operated tacker in accordance with claim 4 wherein the operating means comprises a gear wheel.

6. An electrically-operated tacker in accordance with claim 4 wherein the release means comprises a lever.

7. An electrically-operated tacker in accordance with claim 6 wherein the operating means comprises a gear wheel.

8. An electrically-operated tacker in accordance with claim 1 wherein the operating means comprises a gear wheel.

9. An electrically-operated tacker comprising (a) a driving means initially located in a starting position immediately before a first extreme position for driving a tack into an object to be tacked, (b) means for urging the driving means toward a second extreme position opposite to the first extreme position such that the driving means can spring from the first extreme position to the second extreme position to drive the tack, (c) an operating means for moving the driving means from the second extreme position to the starting position against an action of the urging means, (d) an electric motor for rotating the operating means, (e) a power source for supplying an electric current to the motor, (f) a switch for making or breaking an electrical connection between the power source and the motor, the switch having a push button, (g) a trigger means which can be directly depressed by an operator, (h) a first depressing element connected to the trigger means for depressing the push button of the switch to start the tacker when the trigger means is depressed by the operator, (i) a control member of resilient material for maintaining the first depressing element in an operative position where the first depressing element can depress the push button, the control member being movable between a safety position where a first end of the control member is out of engagement with the first depressing element and a second, opposed end of the control member is out of a housing and an operating position where the first end of the control member is in engagement with the first depressing element and the second end of the control member is in the housing, (j) a safety means for normally maintaining the control member in the safety position where the control member does not allow the push button of the switch to be depressed if the trigger means is depressed, the first end of the control member locating the first depressing element to the operative position when the first end thereof comes into engagement with the first depressing element, (k) a first pin projecting from the operating means and located to engage with the control member, at substantially the same time that the driving means springs from the first extreme position to the second extreme position, such that the first end of the control member is forced out of the engagement with the first depressing element to displace the first depressing element from the operative position to an inoperative position where the first depressing element no longer depresses the push button, (l) a second depressing element connected to the trigger means, the second depressing element coming into engagement with the push button which has already been depressed by the first depressing element, at the same time that the driving means moves away from the first extreme position, and holding the push button depressed after the first depressing element has been displaced to the inoperative position, (m) a second pin projecting from the operating means, (n) a first, or middle cooperative element projecting from the driving means, the second pin coming into engagement with the first cooperative element, after the driving means has reached the second extreme position, and remaining in the engagement with the first cooperative element until the driving means comes to a substantially middle position, (o) a second cooperative element projecting from the driving means and spaced apart from the first cooperative element, the first pin coming into engagement with the second cooperative element, at substantially the same time that the second pin disengages from the first cooperative element, and moving the second cooperative element to return the driving means to the starting position where the second cooperative element is still engaged by the first pin to hold the driving means in the starting position, (p) a release means provided in conjunction with the second depressing element, and (q) a third cooperative element projecting from the driving means and spaced apart from the second cooperative element with the first cooperative element between, the third cooperative element coming into engagement with the release means, at substantially the same time that the driving means reaches the starting position, to operate the release means to disengage the second depressing element from the push button, thereby switching the tacker off, and the first pin moving the driving means for a slight distance to the first extreme position, when the trigger is depressed, and then disengaging from the second cooperative element to allow the driving means to spring to the second extreme position by the action of the urging means.

10. An electrically-operated tacker in accordance with claim 9 wherein at least one of the first and second depressing elements comprises a substantially V-shaped leaf spring located between the trigger means and the switch.

11. An electrically-operated tacker in accordance with claim 10 wherein the release means comprises a lever.

12. An electrically-operated tacker in accordance with claim 11 wherein the operating means comprises a gear wheel.

13. An electrically-operated tacker in accordance with claim 10 wherein the operating means comprises a gear wheel.

14. An electrically-operated tacker in accordance with claim 9 wherein the release means comprises a lever.

15. An electrically-operated tacker in accordance with claim 14 wherein the operating means comprises a gear wheel.

16. An electrically-operated tacker in accordance with claim 9 wherein the operating means comprises a gear wheel.

* * * * *